US010283866B2

(12) United States Patent
Luo et al.

(10) Patent No.: US 10,283,866 B2
(45) Date of Patent: May 7, 2019

(54) ANTENNA AND COMMUNICATIONS DEVICE

(71) Applicant: Huawei Technologies Co., Ltd., Shenzhen (CN)

(72) Inventors: Bing Luo, Chengdu (CN); Zhongli Shi, Chengdu (CN); Wenfei Qin, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 255 days.

(21) Appl. No.: 15/443,438

(22) Filed: Feb. 27, 2017

(65) Prior Publication Data

US 2017/0170567 A1 Jun. 15, 2017

Related U.S. Application Data

(63) Continuation of application No. PCT/CN2015/070897, filed on Jan. 16, 2015.

(30) Foreign Application Priority Data

Aug. 29, 2014 (CN) ..... 2014 1 0438378

(51) Int. Cl.
*H01Q 1/24* (2006.01)
*H01Q 9/04* (2006.01)
(Continued)

(52) U.S. Cl.
CPC ..... *H01Q 9/0407* (2013.01); *H01Q 1/24* (2013.01); *H01Q 1/48* (2013.01); *H01Q 9/0457* (2013.01); *H01Q 21/24* (2013.01)

(58) Field of Classification Search
CPC ..... H01Q 1/243; H01Q 1/48; H01Q 21/24; H01Q 9/0457
(Continued)

(56) References Cited

U.S. PATENT DOCUMENTS 5,973,644 A 10/1999 Haneishi et al.
6,140,969 A * 10/2000 Lindenmeier ..... H01Q 1/1271 343/700 MS
(Continued)

FOREIGN PATENT DOCUMENTS

CN 1949594 A 4/2007
CN 102696149 A 9/2012
(Continued)

OTHER PUBLICATIONS

Foreign Communication From a Counterpart Application, European Application No. 15836592.4, Extended European Search Report dated Nov. 15, 2017, 11 pages.
Machine Translation and Abstract of Chinese Publication No. CN104201469, Dec. 10, 2014, 5 pages.
Machine Translation and Abstract of Chinese Publication No. CN203386903, Jan. 8, 2014, 6 pages.
(Continued)

*Primary Examiner* — Huedung X Mancuso
(74) *Attorney, Agent, or Firm* — Conley Rose, P.C.

(57) ABSTRACT

An antenna and a communications device are presented. The antenna includes a radiating patch configured to transmit and receive a radio frequency signal; a radiating patch reference ground, disposed opposite the radiating patch; a first transmission line configured to transmit the radio frequency signal; a transmission line reference ground, disposed opposite the first transmission line; a first connection portion, connected to the first transmission line, and disposed opposite the radiating patch reference ground; and a first feed portion, including a first transmission line feed portion and two first radiation feed portions, where the two first radiation feed portions are connected to the radiating patch and are configured to receive a radio frequency signal of the radiating patch or transfer a radio frequency signal to the radiating patch; the first transmission line feed portion is
(Continued)

connected to the first transmission line using the first connection portion.

20 Claims, 11 Drawing Sheets

(51) Int. Cl.
*H01Q 1/48* (2006.01)
*H01Q 21/24* (2006.01)

(58) Field of Classification Search
USPC ..... 343/700 MS
See application file for complete search history.

(56) References Cited

U.S. PATENT DOCUMENTS

| | | | | |
|---|---|---|---|---|
| 6,369,762 | B1 | 4/2002 | Yanagisawa et al. | |
| 7,079,080 | B2 * | 7/2006 | Mizuno | H01Q 1/248 343/700 MS |
| 8,797,230 | B2 * | 8/2014 | Leisten | H01Q 1/38 343/700 MS |
| 9,647,338 | B2 * | 5/2017 | Nissinen | H01Q 7/00 |
| 2004/0056803 | A1 | 3/2004 | Soutiaguine et al. | |
| 2005/0110685 | A1 | 5/2005 | Frederik du Toit | |
| 2007/0080878 | A1 | 4/2007 | McLean | |
| 2012/0146865 | A1 | 6/2012 | Hayashi et al. | |

FOREIGN PATENT DOCUMENTS

| | | | |
|---|---|---|---|
| CN | 103337696 | A | 10/2013 |
| CN | 203386903 | U | 1/2014 |
| CN | 104201469 | A | 12/2014 |
| EP | 0685900 | A1 | 5/1995 |
| EP | 0957535 | A1 | 11/1999 |
| EP | 1775795 | A1 | 4/2007 |
| WO | 2007114620 | A1 | 10/2007 |

OTHER PUBLICATIONS

Foreign Communication From a Counterpart Application, Chinese Application No. 201410438378.X, Chinese Application No. 201410438378.X, Chinese Office Action dated Apr. 7, 2016, 5 pages.

Foreign Communication From a Counterpart Application, PCT Application No. PCT/CN2015/070897, English Translation of International Search Report dated May 27, 2015, 2 pages.

Foreign Communication From a Counterpart Application, PCT Application No. PCT/CN2015/070897, English Translation of Written Opinion dated May 27, 2015, 7 pages.

Jung, D., et al., "Modified inset fed microstrip patch antenna," XP10578868, IEEE Microwave Conference, Proceedings of APMC2001, Taipei, Taiwan, R.O.C., vol. 3, Dec. 3, 2001, pp. 1346-1349.

Warnick, K., F., et al., "Education column: A Polarization-Reconfigurable Filtering Antenna System," XP11544396A, IEEE Antennas and Propagation Magazine, vol. 55, No. 6, Dec. 2013, pp. 197-235.

Leeson, D. B., "Waves and Impedances on Transmission Lines," XP55552244A, University of San Diego EEE 194 Section 4: RFandMicrowave Engineering, Spring 2001, Lecture Notes, Jan. 1, 1994, 26 pages.

Foreign Communication From a Counterpart Application, European Application No. 15836592.4, European Office Action dated Feb. 14, 2019, 9 pages.

* cited by examiner

ANTENNA AND COMMUNICATIONS DEVICE

CROSS-REFERENCE TO RELATED APPLICATIONS

This application is a continuation of International Application No. PCT/CN2015/070897 filed on Jan. 16, 2015, which claims priority to Chinese Patent Application No. 201410438378.X filed on Aug. 29, 2014, both of which are hereby incorporated by reference in their entireties.

TECHNICAL FIELD

The present disclosure relates to the field of mobile communications technologies, and in particular, to an antenna and a communications device.

BACKGROUND

A mobile communications system combines a wired manner and a wireless manner. In the mobile communications system, transmission and reception of a spatial wireless signal are both implemented by means of a mobile antenna. As can be seen from this, an antenna plays an important role in a mobile communications network.

As shown in FIG. 15, FIG. 15 is a schematic sectional view of an antenna 800 in the prior art. The antenna 800 includes a radiating patch 81, a reference ground 82 disposed opposite the radiating patch 81, a coaxial line 83, and a circuit board 84 disposed between the radiating patch 81 and the reference ground 82. An outer conductor of the coaxial line 83 is welded on the reference ground 82, an inner conductor of the coaxial line 83 passes through the circuit board 84 and is welded on the radiating patch 81, and the antenna 80 performs feeding using the coaxial line 83.

However, the foregoing coaxial line 83 is directly connected to the radiating patch 81, and the inner conductor that is approximately perpendicular to the radiating patch 81 and the reference ground 82 has a relatively strong inductive characteristic in a circuit, so that a bandwidth of the antenna 800 is relatively narrow.

SUMMARY

This application provides an antenna and a communications device, so as to resolve a technical problem in the prior art that a bandwidth of an antenna is relatively narrow.

A first aspect of embodiments of the present disclosure provides an antenna, where the antenna includes a radiating patch configured to transmit and receive a radio frequency signal; a radiating patch reference ground, disposed opposite the radiating patch; a first transmission line configured to transmit the radio frequency signal; a transmission line reference ground, disposed opposite the first transmission line; a first connection portion, connected to the first transmission line, and disposed opposite the radiating patch reference ground; and a first feed portion, including a first transmission line feed portion and two first radiation feed portions, where the two first radiation feed portions are connected to the radiating patch and are configured to receive a radio frequency signal of the radiating patch or transfer a radio frequency signal to the radiating patch; the first transmission line feed portion is connected to the first transmission line using the first connection portion, so that the first transmission line feed portion and the first transmission line can transmit the radio frequency signal to each other; and mutually coupled feeding is performed between the two first radiation feed portions and the first transmission line feed portion, where the two first radiation feed portions are disposed on a plane, and the first transmission line feed portion is disposed between the two first radiation feed portions, or a projection of the first transmission line feed portion on the plane is located between projections of the two first radiation feed portions on the plane; and a distance between the first connection portion and the radiating patch reference ground is greater than a distance between the first transmission line feed portion and the first radiation feed portions.

In a first possible implementation manner of the first aspect, the antenna further includes a second transmission line configured to transmit the radio frequency signal, and disposed opposite the transmission line reference ground; a second connection portion, connected to the second transmission line, and disposed opposite the radiating patch reference ground; a second feed portion, including a second transmission line feed portion and two second radiation feed portions, where the two second radiation feed portions are connected to the radiating patch and are configured to receive a radio frequency signal of the radiating patch or transfer a radio frequency signal to the radiating patch; the second transmission line feed portion is connected to the second transmission line using the second connection portion, so that the second transmission line feed portion and the second transmission line can transmit the radio frequency signal to each other; and mutually coupled feeding is performed between the two second radiation feed portions and the second transmission line feed portion, where the two second radiation feed portions are disposed on the plane, and the second transmission line feed portion is disposed between the two second radiation feed portions, or a projection of the second transmission line feed portion on the plane is located between projections of the two second radiation feed portions on the plane; a distance between the second connection portion and the radiating patch reference ground is greater than a distance between the second transmission line feed portion and the second radiation feed portions; and polarization directions of radiated electromagnetic waves excited by the second feed portion and the first feed portion are perpendicular to each other, or a phase difference of the radiated electromagnetic waves is 180 degrees.

With reference to the first possible implementation manner of the first aspect, in a second possible implementation manner of the first aspect, the two first radiation feed portions are symmetric with respect to a first straight line, and the first transmission line feed portion itself is symmetric with respect to the first straight line; and the two second radiation feed portions are symmetric with respect to a second straight line, the second transmission feed portion itself is symmetric with respect to the second straight line, and the first straight line and the second straight line are perpendicular or overlapped.

With reference to the first or second possible implementation manner of the first aspect, in a third possible implementation manner of the first aspect, the antenna further includes a top plate, where the top plate includes a lower surface and an upper surface opposite to the lower surface, and the radiating patch is disposed on the upper surface or the lower surface; the first transmission line, the second transmission line, the first connection portion, and the second connection portion are disposed on one surface of the upper surface and the lower surface, and the transmission line reference ground is disposed on the other surface of the upper surface and the lower surface; and the two first radiation feed portions, the first transmission line feed portion, the two second radiation feed portions, and the second transmission line feed portion are disposed on the upper surface or the lower surface.

With reference to the first or second possible implementation manner of the first aspect, in a fourth possible implementation manner of the first aspect, the antenna further includes a top plate and a bottom plate disposed opposite the top plate, where the bottom plate includes an upper surface opposite the top plate and a lower surface opposite to the upper surface; the radiating patch, the two first radiation feed portions, the two second radiation feed portions, the first transmission line feed portion, and the second transmission line feed portion are disposed on the top plate; the radiating patch reference ground is disposed on the bottom plate, and a projection of the radiating patch on the radiating patch reference ground is on the radiating patch reference ground; the first transmission line and the second transmission line are disposed on one surface of the upper surface and the lower surface, the transmission line reference ground is disposed on the other surface of the upper surface and the lower surface, and projections of the first transmission line and the second transmission line on the transmission line reference ground on the surface are located on a projection of the transmission line reference ground on the surface; and the first connection portion and the second connection portion are located between the top plate and the bottom plate.

With reference to the first possible implementation manner of the first aspect, in a fifth possible implementation manner of the first aspect, the antenna further includes a third transmission line and a fourth transmission line configured to transmit the radio frequency signal, and disposed opposite the transmission line reference ground; a third connection portion and a fourth connection portion, disposed opposite the radiating patch reference ground, where the third connection portion is connected to the third transmission line, and the fourth connection portion is connected to the fourth transmission line; a third feed portion, including a third transmission line feed portion and two third radiation feed portions, where the two third radiation feed portions are connected to the radiating patch and are configured to receive a radio frequency signal of the radiating patch or transfer a radio frequency signal to the radiating patch; the third transmission line feed portion is connected to the third transmission line using the third connection portion, so that the third transmission line feed portion and the third transmission line can transmit the radio frequency signal to each other; mutually coupled feeding is performed between the two third radiation feed portions and the third transmission line feed portion, where the two third radiation feed portions are disposed on the plane, and the third transmission line feed portion is disposed between the two third radiation feed portions, or a projection of the third transmission line feed portion on the plane is located between projections of the two third radiation feed portions on the plane; and a distance between the third connection portion and the radiating patch reference ground is greater than a distance between the third transmission line feed portion and the third radiation feed portions; and a fourth feed portion, including a fourth transmission line feed portion and two fourth radiation feed portions, where the two fourth radiation feed portions are connected to the radiating patch and are configured to receive a radio frequency signal of the radiating patch or transfer a radio frequency signal to the radiating patch; the fourth transmission line feed portion is connected to the fourth transmission line using the fourth connection portion, so that the fourth transmission line feed portion and the fourth transmission line can transmit the radio frequency signal to each other; mutually coupled feeding is performed between the two fourth radiation feed portions and the fourth transmission line feed portion, where the two fourth radiation feed portions are disposed on the plane, and the fourth transmission line feed portion is disposed between the two fourth radiation feed portions, or a projection of the fourth transmission line feed portion on the plane is located between projections of the two fourth radiation feed portions on the plane; and a distance between the fourth connection portion and the radiating patch reference ground is greater than a distance between the fourth transmission line feed portion and the fourth radiation feed portions, where the radiating patch is located in an area enclosed by the first connection portion, the second connection portion, the third connection portion, and the fourth connection portion, and polarization directions of radiated electromagnetic waves excited by any two feed portions of the first feed portion, the second feed portion, the third feed portion, and the fourth feed portion are perpendicular to each other, or a phase difference of the radiated electromagnetic waves is 180 degrees.

With reference to the fifth possible implementation manner of the first aspect, in a sixth possible implementation manner of the first aspect, the two first radiation feed portions are symmetric with respect to a first straight line, and the first transmission line feed portion itself is symmetric with respect to the first straight line; the two second radiation feed portions are symmetric with respect to a second straight line, the second transmission feed portion itself is symmetric with respect to the second straight line, and the first straight line and the second straight line are perpendicular; the two third radiation feed portions are symmetric with respect to the first straight line, and the third transmission line feed portion itself is symmetric with respect to the first straight line; and the two fourth radiation feed portions are symmetric with respect to the second straight line, the fourth transmission feed portion itself is symmetric with respect to the second straight line, and the first straight line and the second straight line are perpendicular or overlapped.

With reference to the fifth or sixth possible implementation manner of the first aspect, in a seventh possible implementation manner of the first aspect, the antenna further includes a top plate, where the top plate includes a lower surface and an upper surface opposite to the lower surface, and the radiating patch is disposed on the upper surface or the lower surface; the first transmission line, the second transmission line, the third transmission line, the first connection portion, the second connection portion, and the third connection portion are disposed on one surface of the upper surface and the lower surface, and the transmission line reference ground is disposed on the other surface of the upper surface and the lower surface; and the two first radiation feed portions, the first transmission line feed portion, the two second radiation feed portions, the second transmission line feed portion, the two third radiation feed portions, and the third transmission line feed portion are disposed on the upper surface or the lower surface.

With reference to the fifth or sixth possible implementation manner of the first aspect, in an eighth possible implementation manner of the first aspect, the antenna further includes a top plate and a bottom plate disposed opposite the top plate, where the bottom plate includes an upper surface opposite the top plate and a lower surface opposite to the upper surface; the radiating patch, the two first radiation feed portions, the two second radiation feed portions, the two third radiation feed portions, the first transmission line feed portion, the second transmission line feed portion, and the third transmission line feed portion are disposed on the top plate; the radiating patch reference ground is disposed on the bottom plate, and a projection of the radiating patch on the radiating patch reference ground is on the radiating patch reference ground; the first transmission line, the second transmission line, and the third transmission line are disposed on one surface of the upper surface and the lower surface, the transmission line reference ground is disposed on the other surface of the upper surface and the lower surface, and projections of the first transmission line, the second transmission line, and the third transmission line on the transmission line reference ground on the surface are located on a projection of the transmission line reference ground on the surface; and the first connection portion, the second connection portion, and the third connection portion are located between the top plate and the bottom plate.

With reference to the first aspect, in a ninth possible implementation manner of the first aspect, the two first radiation feed portions are symmetric with respect to a straight line, and the first transmission line feed portion itself is symmetric with respect to the straight line.

With reference to the first aspect or the ninth possible implementation manner of the first aspect, in the third possible implementation manner of the first aspect, the antenna further includes a top plate, where the top plate includes a lower surface and an upper surface opposite to the lower surface, and the radiating patch is disposed on the upper surface or the lower surface; the first transmission line and the first connection portion are disposed on one surface of the upper surface and the lower surface, and the transmission line reference ground is disposed on the other surface of the upper surface and the lower surface; and the two first radiation feed portions and the first transmission line feed portion are disposed on the upper surface or the lower surface.

With reference to the third, seventh, or tenth possible implementation manner of the first aspect, in an eleventh possible implementation manner of the first aspect, there are two radiating patches, separately disposed on the upper surface and the lower surface.

With reference to the third, seventh, tenth, or eleventh possible implementation manner of the first aspect, in a twelfth possible implementation manner of the first aspect, the antenna further includes a bottom plate disposed opposite the radiating patch, a surface, of the bottom plate, opposite the radiating patch is partially concave to form a groove, and the radiating patch reference ground is disposed at a bottom of the groove.

With reference to the first aspect or the ninth possible implementation manner of the first aspect, in a thirteenth possible implementation manner of the first aspect, the antenna further includes a top plate and a bottom plate disposed opposite the top plate, where the bottom plate includes an upper surface opposite the top plate and a lower surface opposite to the upper surface; the radiating patch, the two first radiation feed portions, and the first transmission line feed portion are disposed on the top plate; the radiating patch reference ground is disposed on the bottom plate, and a projection of the radiating patch on the radiating patch reference ground is on the radiating patch reference ground; the first transmission line is disposed on one surface of the upper surface and the lower surface, the transmission line reference ground is disposed on the other surface of the upper surface and the lower surface, and a projection of the first transmission line on the transmission line reference ground on the surface is located on a projection of the transmission line reference ground on the surface; and the first connection portion is located between the top plate and the bottom plate.

A second aspect of the embodiments of the present disclosure provides a communications device, where the communications device includes an antenna and a transceiver configured to receive a signal from the antenna or send a signal to the antenna.

This application has the following beneficial effects.

In the foregoing antenna, the first connection portion disposed opposite the radiating patch reference ground, the two first radiation feed portions located on one plane, and the first transmission line feed portion that is located between the two first radiation feed portions or whose projection is located between the two first radiation feed portions are disposed; further, based on a principle in which an inductive characteristic strength is directly proportional to a distance and a capacitive characteristic strength is inversely proportional to a distance, because the distance between the first connection portion and the radiating patch reference ground is greater than the distance between the first transmission line feed portion and the first radiation feed portions, an inductive characteristic of the first connection portion is relatively strong, and a capacitive characteristic of the first transmission line feed portion is relatively strong, so that a presented actual input impedance of the antenna is close to an ideal transmission impedance, a standing wave ratio is reduced, a bandwidth of the antenna is broadened, and a technical problem in the prior art that a bandwidth of the antenna is relatively narrow because in the foregoing a coaxial line is directly connected to a radiating patch and an inner conductor that is approximately perpendicular to the radiating patch has a relatively strong inductive characteristic in a circuit is resolved.

DESCRIPTION OF EMBODIMENTS

To make persons skilled in the art understand the solutions in the present application better, the following clearly describes the technical solutions in the embodiments of the present application with reference to the accompanying drawings in the embodiments of the present application. The described embodiments are merely some but not all of the embodiments of the present application.

Embodiment 1

Figure 1:
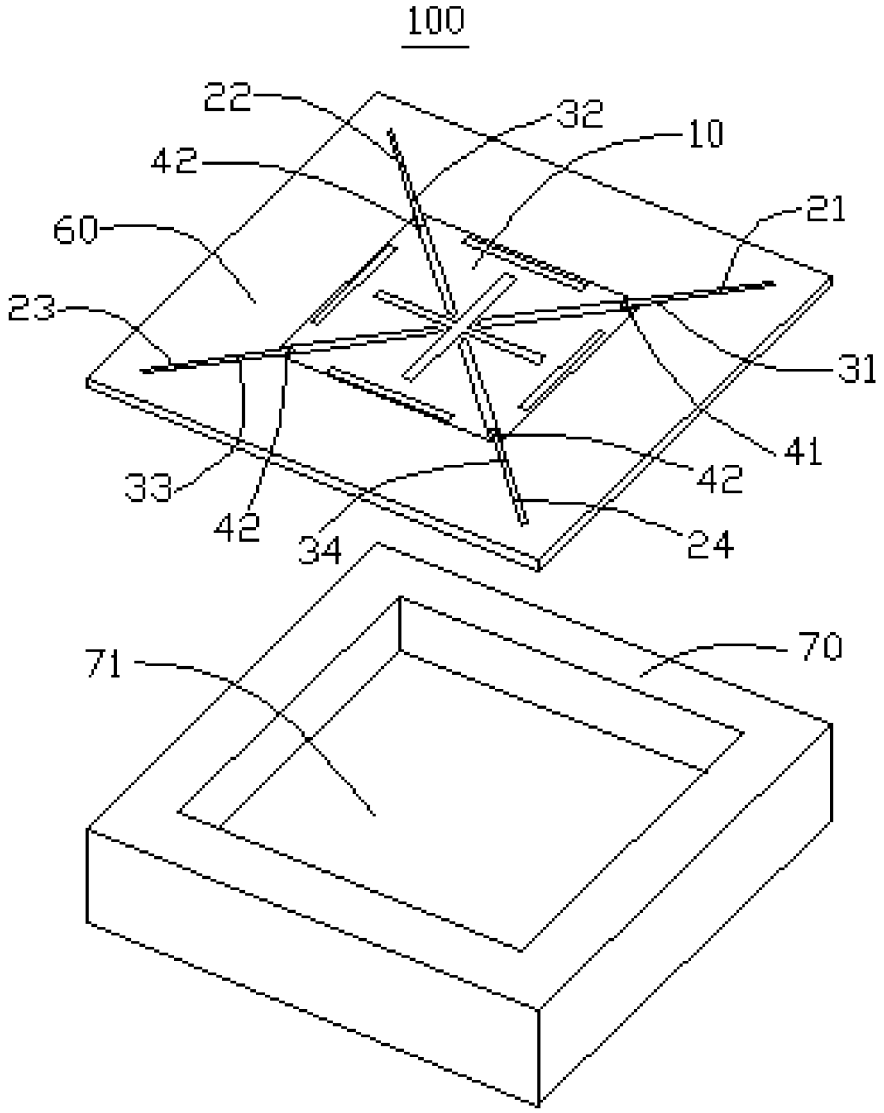
FIG. 1 is a schematic structural exploded view of an antenna according to a first implementation manner of this application.

As shown in FIG. 1, FIG. 1 is a schematic structural exploded view of an antenna 100 according to a first exemplary implementation manner of this application. The antenna 100 includes a radiating patch 10, a radiating patch reference ground 11, a first transmission line 21, a second transmission line 22, a third transmission line 23, a fourth transmission line 24, a transmission line reference ground 211, a first connection portion 31, a second connection portion 32, a third connection portion 33, a fourth connection portion 34, a first feed portion 41, a second feed portion 42, a third feed portion 43, and a fourth feed portion 44.

The radiating patch 10 is configured to transmit and receive a radio frequency signal. The radiating patch 10 may be a copper sheet, or a copper foil attached to a plate. A shape of the radiating patch 10 may be set according to a requirement, for example, set to a symmetric shape, or may be set to an asymmetric shape. In this implementation manner, that the shape of the radiating patch 10 is a symmetric shape is used for description. The radiating patch 10 itself is symmetric with respect to four lines of symmetry, the four lines of symmetry intersect at a same intersection, and an included angle between two adjacent lines of symmetry is 45 degrees.

The radiating patch reference ground 11 and the radiating patch 10 are disposed opposite, to form a reference ground of the radiating patch 10, and a projection of the radiating patch 11 on a plane on which the radiating patch reference ground 11 is located is located on a projection of the radiating patch reference ground 11 on the plane.

The first transmission line 21, the second transmission line 22, the third transmission line 23, and the fourth transmission line 24 are all configured to transmit the radio frequency. The first transmission line 21, the second transmission line 22, the third transmission line 23, and the fourth transmission line 24 may be in a straight-line form, or may be in a curved shape or another shape. The first transmission line 21, the second transmission line 22, the third transmission line 23, and the fourth transmission line 24 may be in a same shape, or may be in different shapes. In this implementation manner, the first transmission line 21, the second transmission line 22, the third transmission line 23, and the fourth transmission line 24 are microstrips. In another implementation manner, the first transmission line 21, the second transmission line 22, the third transmission line 23, and the fourth transmission line 24 may be coplanar waveguides, strip lines, or the like.

The first transmission line 21, the second transmission line 22, the third transmission line 23, and the fourth transmission line 24 are all disposed opposite the transmission line reference ground 211. Projections of the first transmission line 21, the second transmission line 22, the third transmission line 23, and the fourth transmission line 24 on a plane on which the transmission line reference ground 211 is located are located on a projection of the transmission line 21 on the plane.

The first connection portion 31 is connected to the first transmission line 21, the second connection portion 32 is connected to the second transmission line 22, the third connection portion 33 is connected to the third transmission line 23, and the fourth connection portion 34 is connected to the fourth transmission line 24. The first connection portion 31, the second connection portion 32, the third connection portion 33, and the fourth connection portion 34 are disposed opposite the radiating patch reference ground 11. Projections of the first connection portion 31, the second connection portion 32, the third connection portion 33, and the fourth connection portion 34 on the plane on which the radiating patch reference ground 11 is located are located on the projection of the radiating patch reference ground 11 on the plane.

In this implementation manner, the antenna 100 further includes a top plate 60 that has an upper surface and a lower surface opposite to the upper surface. The top plate 60 is configured to support and fix the radiating patch 10, the first feed portion 41, the second feed portion 42, the third feed portion 43, the fourth feed portion 44, the first connection portion 31, the second connection portion 32, the third connection portion 33, the fourth connection portion 34, the first transmission line 21, the second transmission line 22, the third transmission line 23, and the fourth transmission line 24. The top plate 60 may be a circuit board, a steel sheet, a plastic sheet, or the like. In this implementation manner, the first feed portion 41, the second feed portion 42, the third feed portion 43, the fourth feed portion 44, the first connection portion 31, the second connection portion 32, the third connection portion 33, the fourth connection portion 34, the first transmission line 21, the second transmission line 22, the third transmission line 23, and the fourth transmission line 24 are all disposed on the upper surface, and the transmission line reference ground 211 is disposed on the lower surface. In another implementation manner, the first feed portion 41, the second feed portion 42, the third feed portion 43, and the fourth feed portion 44 may be disposed on the lower surface or the upper surface, the first connection portion 31, the second connection portion 32, the third connection portion 33, and the fourth connection portion 34 may be disposed on the lower surface or the upper surface, the first transmission line 21, the second transmission line 22, the third transmission line 23, and the fourth transmission line 24 are disposed on one surface of the upper surface and the lower surface, and the transmission line reference ground 211 is disposed on the other surface of the upper surface and the lower surface.

Figure 3:
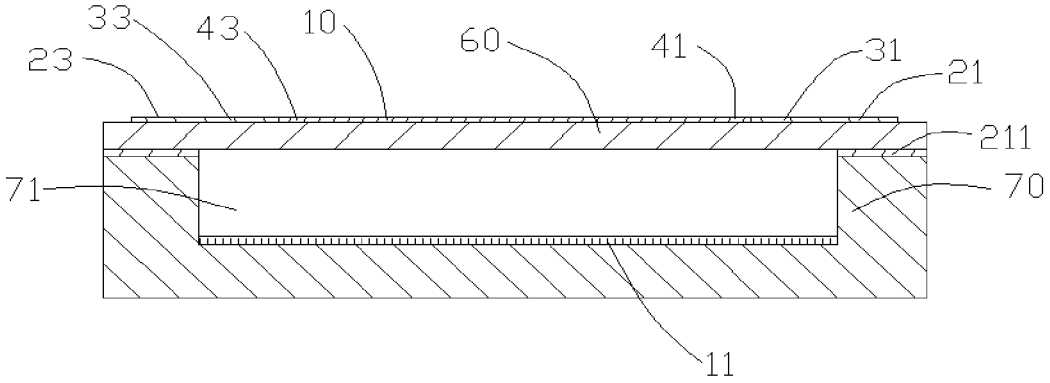
FIG. 3 is a schematic sectional view in a direction A-A of the antenna in FIG. 2.
Figure 6:
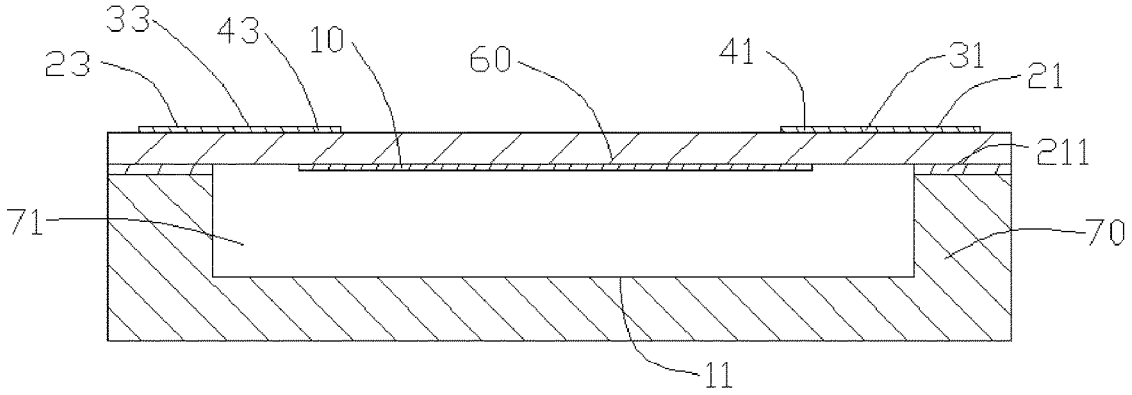
FIG. 6 is a schematic sectional view of the antenna in FIG. 5.
Figure 7:
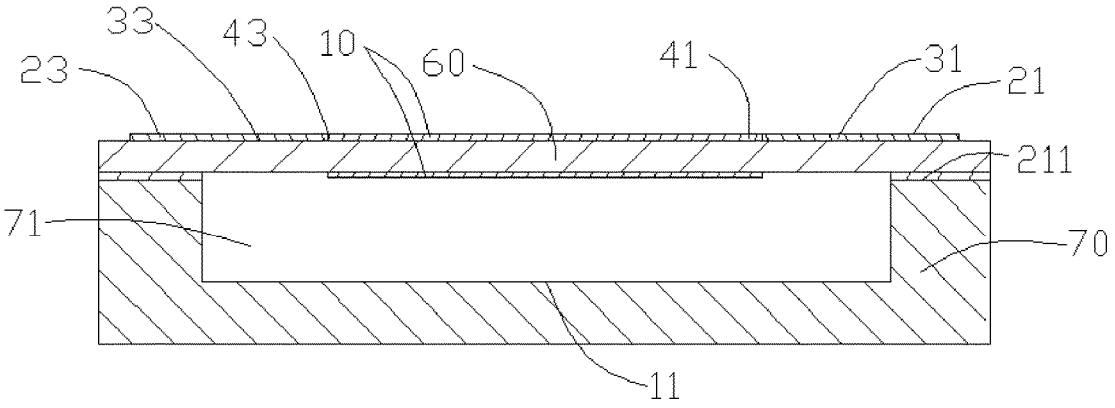
FIG. 7 is a schematic sectional view of an antenna according to a third implementation manner of this application.

Correspondingly, when the antenna 100 includes the top plate 60, the radiating patch 10 is disposed on the upper surface or the lower surface. As shown in FIG. 3, the radiating patch 10 is disposed on the upper surface of the top plate 60, and as shown in FIG. 6, the radiating patch 10 is disposed on the lower surface of the top plate 60. In another implementation manner, as shown in FIG. 7, there may be two radiating patches 10, and the two radiating patches 10 are separately disposed on the upper surface and the lower surface.

In another implementation manner, effects of supporting and fixation can be implemented in a manner without disposing the top plate 60, and effects of supporting and fixation are implemented using another manner such as a support.

In this implementation manner, the "or/and" refers to a description of a relationship between two items, for example, A or/and B includes three cases: a first case is that only A exists, a second case is that only B exists, and a third case is that both A and B exist.

The first feed portion 41 includes two first radiation feed portions 411 and a first transmission line feed portion 412. Mutually coupled feeding can be performed between the two first radiation feed portions 411 and the first transmission line feed portion 412. The two first radiation feed portions 411 are connected to the radiating patch 10 and are configured to receive a radio frequency signal of the radiating patch 10 or transfer a radio frequency signal to the radiating patch 10. The first transmission line feed portion 412 is connected to the first transmission line 21 using the first connection portion 31, that is, the first connection portion 31 is configured to connect the first transmission line feed portion 412 and the first transmission line 21, so that the first transmission line feed portion 412 and the first transmission line 21 can transmit the radio frequency signal to each other using the first connection portion 31.

The two first radiation feed portions 411 are disposed on a plane, and the first transmission line feed portion 412 is disposed between the two first radiation feed portions 411, or a projection of the first transmission line feed portion 412 on the plane is located between projections of the two first radiation feed portions 411 on the plane, so that mutually coupled feeding can be performed between the first transmission line feed portion 412 and the two first radiation feed portions 411. A distance between the first connection portion 31 and the radiating patch reference ground 11 is greater than a distance between the first transmission line feed portion 412 and the first radiation feed portions 411.

A signal on the first transmission line 21 is transmitted to the first transmission line feed portion 412 using the first connection portion 31, is then coupled to the two first radiation feed portions 411, and is radiated using the radiating patch 10. When receiving the signal, the radiating patch 10 couples the received signal to the first transmission line feed portion 412 using the two first radiation feed portions 411, and then transfers the signal to the first transmission line 21 using the first connection portion 31.

The second feed portion 42 includes two second radiation feed portions 421 and a second transmission line feed portion 422. Mutually coupled feeding can be performed between the two second radiation feed portions 421 and the second transmission line feed portion 422. The two second radiation feed portions 421 are connected to the radiating patch 10 and are configured to receive a radio frequency signal of the radiating patch 10 or transfer a radio frequency signal to the radiating patch 10. The second transmission line feed portion 422 is connected to the second transmission line 22 using the second connection portion 32, that is, the second connection portion 32 is configured to connect the second transmission line feed portion 422 and the second transmission line 22, so that the second transmission line feed portion 422 and the second transmission line 22 can transmit the radio frequency signal to each other using the second connection portion 32.

The two second radiation feed portions 421 are disposed on the plane on which the two first radiation feed portions 411 are disposed, and the second transmission line feed portion 422 is disposed between the two second radiation feed portions 421, or a projection of the second transmission line feed portion 422 on the plane is located between projections of the two second radiation feed portions 421 on the plane, so that mutually coupled feeding can be performed between the second transmission line feed portion 422 and the two second radiation feed portions 421. A distance between the second connection portion 32 and the radiating patch reference ground 11 is greater than a distance between the second transmission line feed portion 422 and the second radiation feed portions 421.

A signal on the second transmission line 22 is transmitted to the second transmission line feed portion 422 using the second connection portion 32, is then coupled to the two second radiation feed portions 421, and is radiated using the radiating patch 10. When receiving the signal, the radiating patch 10 couples the received signal to the second transmission line feed portion 422 using the two second radiation feed portions 421, and then transfers the signal to the second transmission line 22 using the second connection portion 32.

The third feed portion 43 includes two third radiation feed portions 431 and a third transmission line feed portion 432, and mutually coupled feeding can be performed between the two third radiation feed portions 431 and the third transmission line feed portion 432. The two third radiation feed portions 431 are connected to the radiating patch 10 and are configured to receive a radio frequency signal of the radiating patch 10 or transfer a radio frequency signal to the radiating patch 10. The third transmission line feed portion 432 is connected to the third transmission line 23 using the third connection portion 33, that is, the third connection portion 33 is configured to connect the third transmission line feed portion 432 and the third transmission line 23, so that the third transmission line feed portion 432 and the third transmission line 23 can transmit the radio frequency signal to each other using the third connection portion 33.

The two third radiation feed portions 431 are disposed on the plane on which the two first radiation feed portions 411 are disposed, and the third transmission line feed portion 432 is disposed between the two third radiation feed portions 431, or a projection of the third transmission line feed portion 432 on the plane is located between projections of the two third radiation feed portions 431 on the plane, so that mutually coupled feeding can be performed between the third transmission line feed portion 432 and the two third radiation feed portions 431. A distance between the third connection portion 33 and the radiating patch reference ground 11 is greater than a distance between the third transmission line feed portion 432 and the third radiation feed portions 431.

A signal on the third transmission line 23 is transmitted to the third transmission line feed portion 432 using the third connection portion 33, is then coupled to the two third radiation feed portions 431, and is radiated using the radiating patch 10. When receiving the signal, the radiating patch 10 couples the received signal to the third transmission line feed portion 432 using the two third radiation feed portions 431, and then transfers the signal to the third transmission line 23 using the third connection portion 33.

The fourth feed portion 44 includes two fourth radiation feed portions 441 and a fourth transmission line feed portion 442, and mutually coupled feeding can be performed between the two fourth radiation feed portions 441 and the fourth transmission line feed portion 442. The two fourth radiation feed portions 441 are connected to the radiating patch 10 and are configured to receive a radio frequency signal of the radiating patch 10 or transfer a radio frequency signal to the radiating patch 10. The fourth transmission line feed portion 442 is connected to the fourth transmission line 24 using the fourth connection portion 34, that is, the fourth connection portion 34 is configured to connect the fourth transmission line feed portion 442 and the fourth transmission line 24, so that the fourth transmission line feed portion 442 and the fourth transmission line 24 can transmit the radio frequency signal to each other using the fourth connection portion 34.

The two fourth radiation feed portions 441 are disposed on the plane on which the two first radiation feed portions 411 are disposed, and the fourth transmission line feed portion 442 is disposed between the two fourth radiation feed portions 441, or a projection of the fourth transmission line feed portion 442 on the plane is located between projections of the two fourth radiation feed portions 441 on the plane, so that mutually coupled feeding can be performed between the fourth transmission line feed portion 442 and the two fourth radiation feed portions 441. A distance between the fourth connection portion 34 and the radiating patch reference ground 11 is greater than a distance between the fourth transmission line feed portion 442 and the fourth radiation feed portions 441.

The radiating patch 10 is located in an area enclosed by the first connection portion 31, the second connection portion 32, the third connection portion 33, and the fourth connection portion 34. Polarization directions of radiated electromagnetic waves excited by any two feed portions of the first feed portion 41, the second feed portion 42, the third feed portion 43, and the fourth feed portion 44 are perpendicular to each other, or a phase difference of the radiated electromagnetic waves is 180 degrees.

A signal on the fourth transmission line 24 is transmitted to the fourth transmission line feed portion 442 using the fourth connection portion 34, is then coupled to the two fourth radiation feed portions 441, and is radiated using the radiating patch 10. When receiving the signal, the radiating patch 10 couples the received signal to the fourth transmission line feed portion 442 using the two fourth radiation feed portions 441, and then transfers the signal to the fourth transmission line 24 using the fourth connection portion 34.

The first connection portion 31, the second connection portion 32, the third connection portion 33, and the fourth connection portion 34 that are disposed opposite the radiating patch reference ground 11, the two first radiation feed portions 411, the two second radiation feed portions 421, the two third radiation feed portions 431, and the two third radiation feed portions 431 that are located on one plane, and the first transmission line feed portion 412, the second transmission line feed portion 422, the third transmission line feed portion 432, and the fourth transmission line feed portion 442 are disposed. Based on a principle in which an inductive characteristic strength is directly proportional to a distance and a capacitive characteristic strength is inversely proportional to a distance, because a distance between each of the first connection portion 31, the second connection portion 32, the third connection portion 33, and the fourth connection portion 34 and the radiating patch reference ground 11 is greater than a distance between each of the first transmission line feed portion 412, the second transmission line feed portion 422, the third transmission line feed portion 432, and the fourth transmission line feed portion 442 and the two first radiation feed portions 411, inductive characteristics of the first connection portion 31, the second connection portion 32, the third connection portion 33, and the fourth connection portion 34 are relatively strong, and capacitive characteristics of the first transmission line feed portion 412, the second transmission line feed portion 422, the third transmission line feed portion 432, and the fourth transmission line feed portion 442 are relatively strong, so that a presented actual input impedance of the antenna is close to an ideal transmission impedance, a standing wave ratio is reduced, a bandwidth of the antenna 100 is broadened, and a technical problem in the prior art that a bandwidth of the antenna is relatively narrow because in the foregoing a coaxial line is directly connected to a radiating patch and an inner conductor that is approximately perpendicular to the radiating patch has a relatively strong inductive characteristic in a circuit is resolved.

Figure 4:
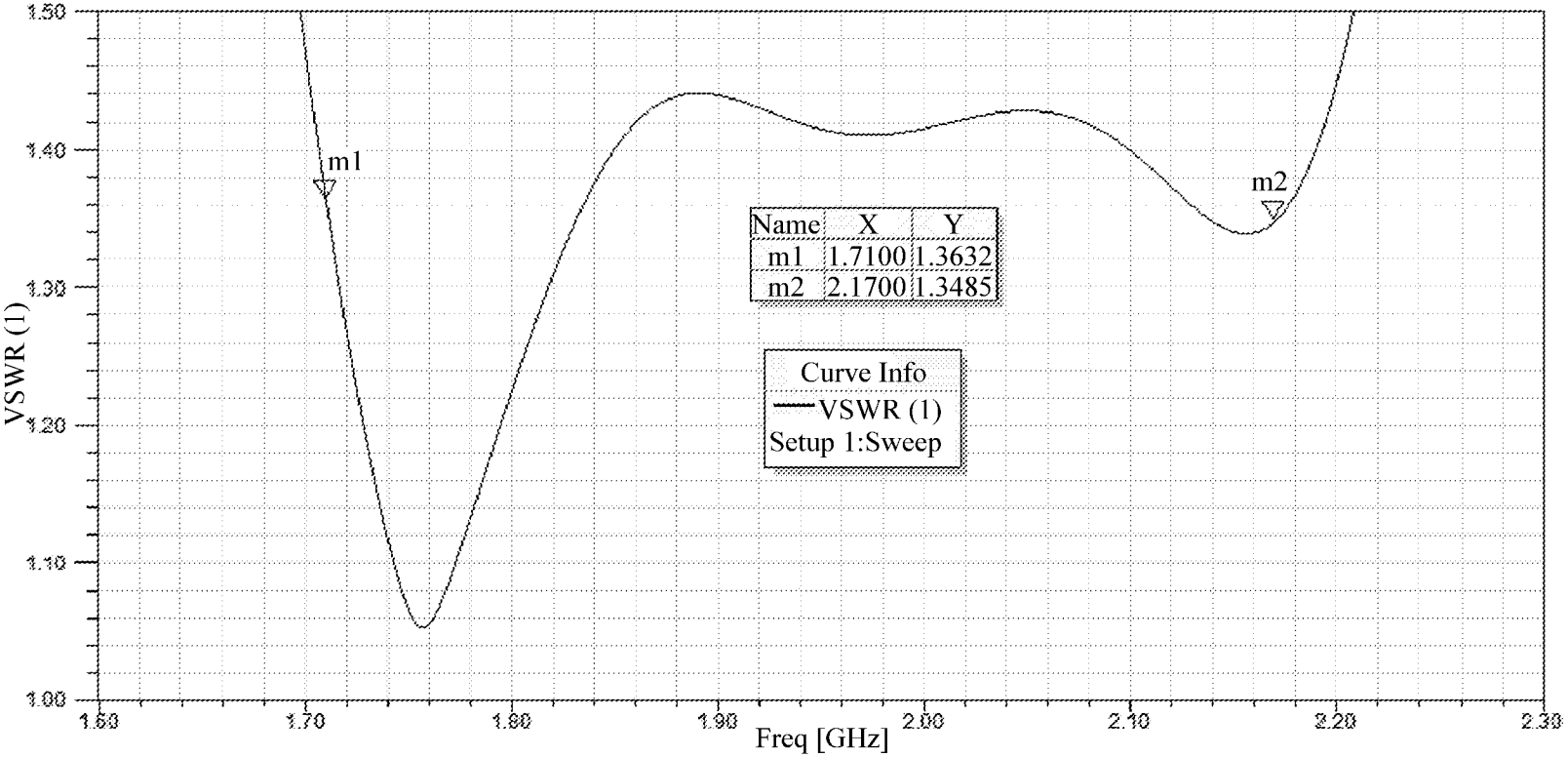
FIG. 4 is a standing wave pattern of the antenna in FIG. 1.

For the antenna 100 shown in FIG. 1, simulation software is used to perform modeling and simulation, and a simulation result thereof is shown in FIG. 4. The antenna 100 has a height (a distance between the radiating patch 10 and a radiating patch reference ground 30) of 15 millimeter (mm). Within an operating band of 1710 megahertz (MHz) to 2170 MHz, a voltage standing wave ratio (VSWR) of the antenna is less than 1.5, that is, a return loss is less than −14 decibels (dB). In this case, a fractional bandwidth of the antenna 100 is 23.7%, so that requirements for a required low profile and broadbandization are met.

Figure 2:
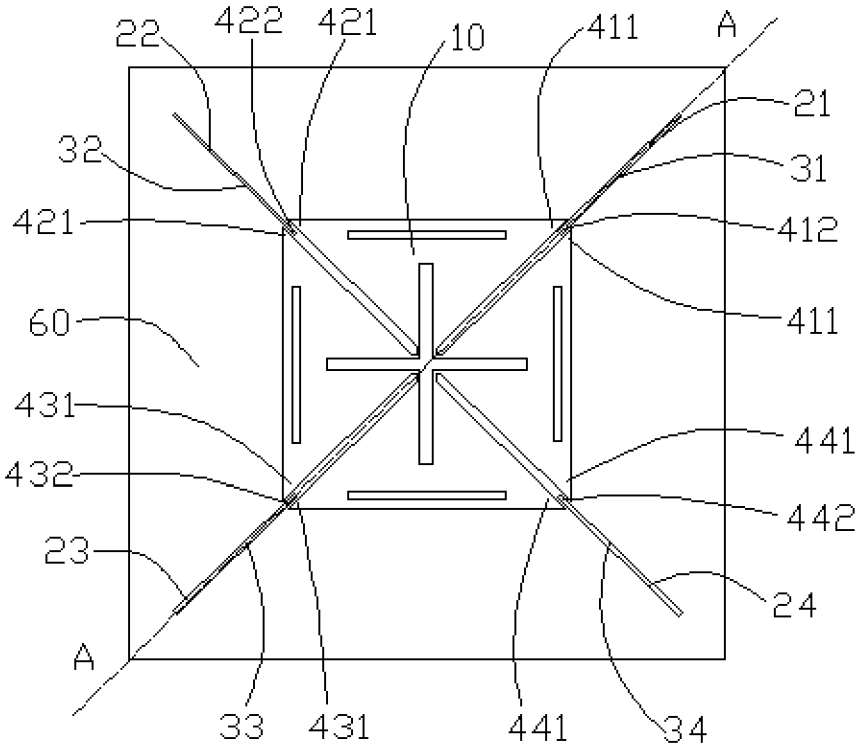
FIG. 2 is a top view of the antenna in FIG. 1.
Figure 5:
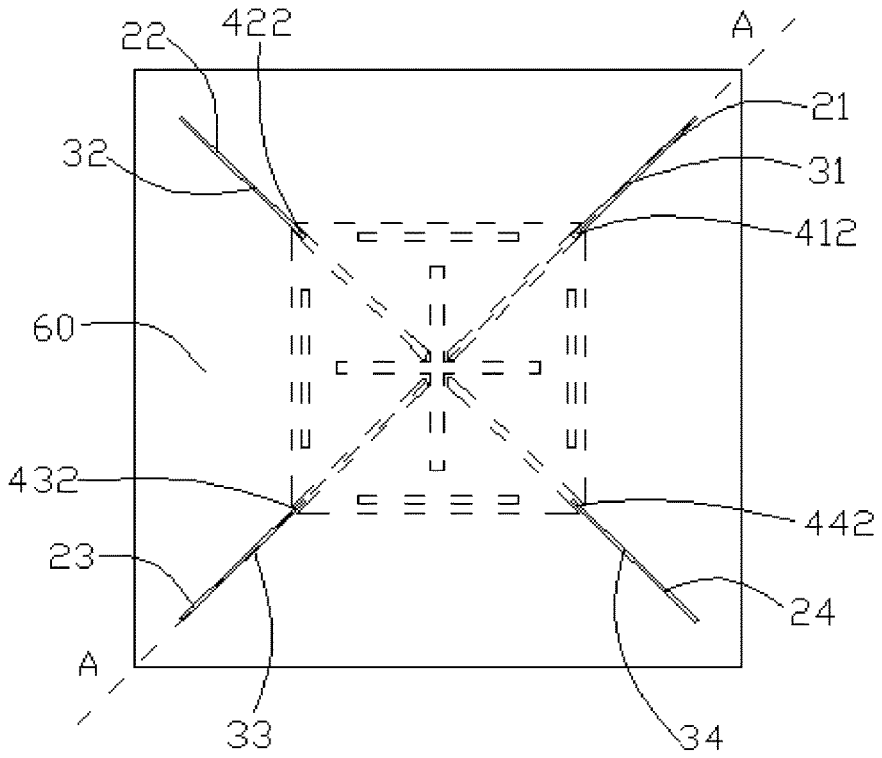
FIG. 5 is a top view of an antenna according to a second implementation manner of this application.

In this implementation manner, as shown in FIG. 1, FIG. 2, and FIG. 3, the radiating patch 10, the first transmission line 21, the second transmission line 22, the third transmission line 23, the fourth transmission line 24, the first connection portion 31, the second connection portion 32, the third connection portion 33, the fourth connection portion 34, the first feed portion 41, the second feed portion 42, the third feed portion 43, and the fourth feed portion 44 are all disposed on the upper surface of the top plate 60, and the transmission line reference ground 211 is disposed on the lower surface of the top plate 60. The first transmission line feed portion 412 is disposed between the two first radiation feed portions 411, the second transmission line feed portion 422 is disposed between the two second radiation feed portions 421, the third transmission line feed portion 432 is disposed between the two third radiation feed portions 431, and the fourth transmission line feed portion 442 is disposed between the two fourth radiation feed portions 441. In another implementation manner, as shown in FIG. 5 and FIG. 6, the radiating patch 10, the two first radiation feed portions 411, the two second radiation feed portions 421, the two third radiation feed portions 431, the two fourth radiation feed portions 441, and the transmission line reference ground 211 are disposed on the lower surface of the top plate 60. The first transmission line 21, the second transmission line 22, the third transmission line 23, the fourth transmission line 24, the first connection portion 31, the second connection portion 32, the third connection portion 33, the fourth connection portion 34, the first transmission line feed portion 412, the second transmission line feed portion 422, the third transmission line feed portion 432, and the fourth transmission line feed portion 442 are disposed on the upper surface of the top plate 60. A projection of the first transmission line feed portion 412 on the plane (that is, the lower surface of the top plate 60) is located between projections of the two first radiation feed portions 411 on the plane; a projection of the second transmission line feed portion 422 on the plane (that is, the lower surface of the top plate 60) is located between projections of the two second radiation feed portions 421 on the plane; a projection of the third transmission line feed portion 432 on the plane (that is, the lower surface of the top plate 60) is located between projections of the two third radiation feed portions 431 on the plane; and a projection of the fourth transmission line feed portion 442 on the plane (that is, the lower surface of the top plate 60) is located between projections of the two fourth radiation feed portions 441 on the plane.

Further, as shown in FIG. 7, there are two radiating patches 10, which are separately disposed on the upper surface and the lower surface of the top plate 60. The two first radiation feed portions 411, the two second radiation feed portions 421, the two third radiation feed portions 431, and the two fourth radiation feed portions 441 that are connected to the radiating patches 10 are disposed on both the upper surface and the lower surface of the top plate 60. The first transmission line 21, the second transmission line 22, the third transmission line 23, the fourth transmission line 24, the first connection portion 31, the second connection portion 32, the third connection portion 33, the fourth connection portion 34, the first transmission line feed portion 412, the second transmission line feed portion 422, the third transmission line feed portion 432, and the fourth transmission line feed portion 442 are disposed on the upper surface of the top plate 60, and the transmission line reference ground 40 is disposed on the lower surface of the top plate 60.

Figure 8:
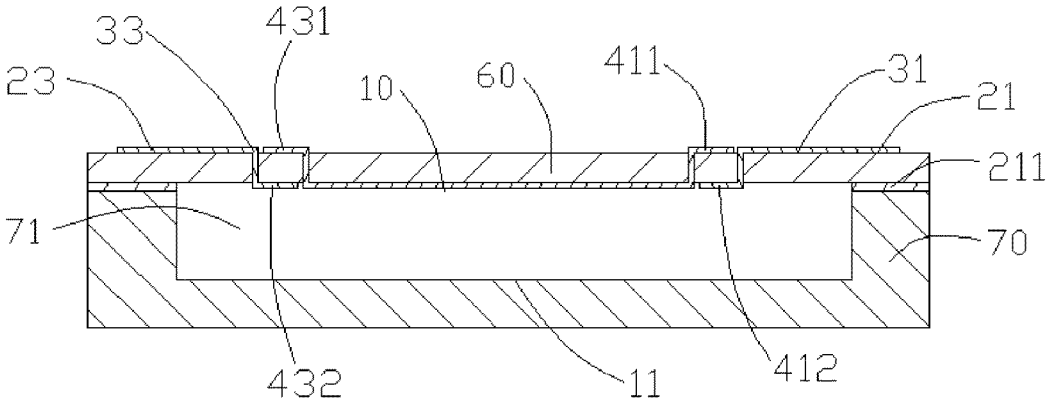
FIG. 8 is a schematic sectional view of an antenna according to a fourth implementation manner of this application.

In the foregoing manner, the radiating patches 10, the two first radiation feed portions 411, the two second radiation feed portions 421, the two third radiation feed portions 431, and the two fourth radiation feed portions 441 are located on a same surface of the top plate 60. The first transmission line 21, the second transmission line 22, the third transmission line 23, the fourth transmission line 24, the first connection portion 31, the second connection portion 32, the third connection portion 33, the fourth connection portion 34, the first transmission line feed portion 412, the second transmission line feed portion 422, the third transmission line feed portion 432, and the fourth transmission line feed portion 442 are also disposed on a same surface of the top plate 60. In another implementation manner, the radiating patches 10, the two first radiation feed portions 411, the two second radiation feed portions 421, the two third radiation feed portions 431, and the two fourth radiation feed portions 441 may be separately located on the upper surface and the lower surface of the top plate 60. The first transmission line 21, the second transmission line 22, the third transmission line 23, the fourth transmission line 24, the first connection portion 31, the second connection portion 32, the third connection portion 33, the fourth connection portion 34, the first transmission line feed portion 412, the second transmission line feed portion 422, the third transmission line feed portion 432, and the fourth transmission line feed portion 442 may also be separately located on the upper surface and the lower surface of the top plate 60. As shown in FIG. 8, the first transmission line 21, the second transmission line 22, the third transmission line 23, the fourth transmission line 24, the first connection portion 31, the second connection portion 32, the third connection portion 33, the fourth connection portion 34, the two first radiation feed portions 411, the two second radiation feed portions 421, the two third radiation feed portions 431, and the two fourth radiation feed portions 441 are disposed on the upper surface of the top plate 60. The radiating patch 10, the first transmission line feed portion 412, the second transmission line feed portion 422, the third transmission line feed portion 432, and the fourth transmission line feed portion 442 are disposed on the lower surface.

In this implementation manner, as shown in FIG. 2, the antenna 100 includes the first transmission line 21, the second transmission line 22, the third transmission line 23, the fourth transmission line 24, the first connection portion 31, the second connection portion 32, the third connection portion 33, the fourth connection portion 34, the first feed portion 41, the second feed portion 42, the third feed portion 43, and the fourth feed portion 44. Polarization directions of radiated electromagnetic waves excited by two adjacent feed portions of the first feed portion 41, the second feed portion 42, the third feed portion 43, and the fourth feed portion 44 are perpendicular to each other. Preferably, the two first radiation feed portions 411 are symmetric with respect to a first straight line, and the first transmission line feed portion 412 itself is symmetric with respect to the first straight line. The two second radiation feed portions 421 are symmetric with respect to a second straight line, and the second transmission line feed portion 422 itself is symmetric with respect to the second straight line. The two third radiation feed portions 431 are symmetric with respect to the first straight line, and the third transmission line feed portion 432 itself is symmetric with respect to the first straight line. The two fourth radiation feed portions 441 are symmetric with respect to the second straight line, and the fourth transmission line feed portion 442 itself is symmetric with respect to the second straight line. The first straight line and the second straight line are perpendicular or overlapped. The first transmission line 21, the second transmission line 22, the third transmission line 23, the fourth transmission line 24, the first feed portion 41, the second feed portion 42, the third feed portion 43, and the fourth feed portion 44 are disposed, and the polarization directions of the radiated electromagnetic waves excited by two adjacent feed portions of the first feed portion 41, the second feed portion 42, the third feed portion 43, and the fourth feed portion 44 are perpendicular to each other, so that not only the antenna 100 becomes a dual-polarized antenna, but also when signals excited by the first feed portion 41 and the third feed portion 43 that are co-polarized and the second feed portion 42 and the fourth feed portion 44 that are co-polarized have a phase difference of 180 degrees, the antenna 100 can be further enabled to implement balanced feeding.

Figure 9:
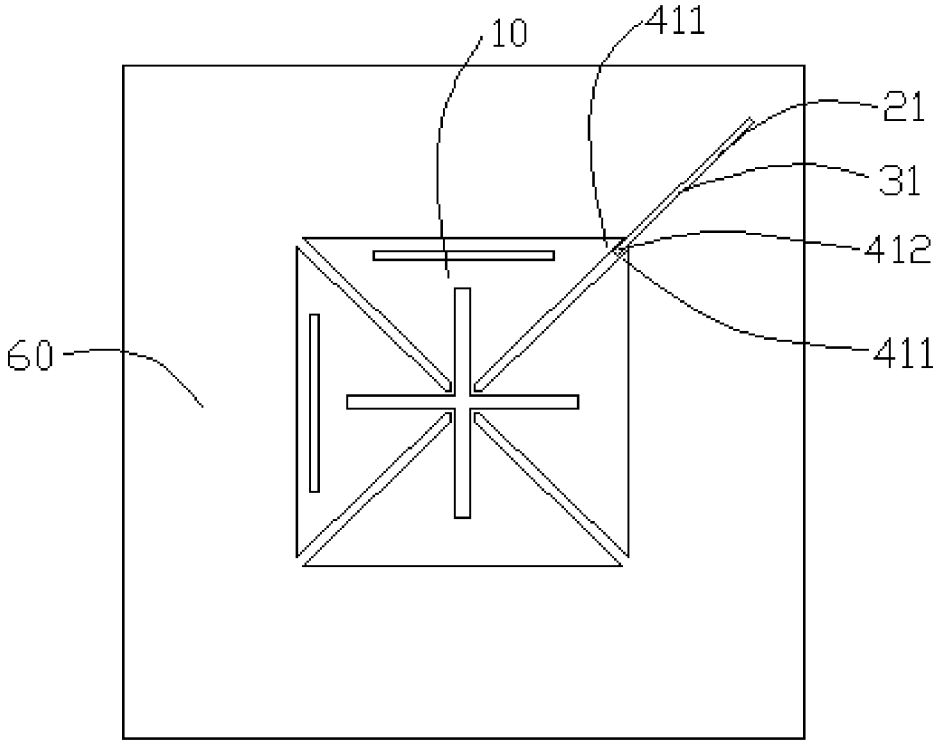
FIG. 9 is a top view of an antenna according to a fifth implementation manner of this application.

In another implementation manner, as shown in FIG. 9, the antenna 100 is a single-polarized antenna. The antenna 100 includes the first transmission line 21, the first connection portion 31, and the first feed portion 41. Preferably, the two first radiation feed portions 411 of the first feed portion 41 are symmetric with respect to a straight line, and the first transmission line feed portion 412 itself is symmetric with respect to the same straight line. The first connection portion 31 disposed opposite the radiating patch reference ground 11, the two first radiation feed portions 411 located on one plane, and the first transmission line feed portion 412 are disposed. Based on a principle in which an inductive characteristic strength is directly proportional to a distance and a capacitive characteristic strength is inversely proportional to a distance, because a distance between the first connection 31 and the radiating patch reference ground 11 is greater than a distance between the first transmission line feed portion 412 and the two first radiation feed portions 411, an inductive characteristic of the first connection portion 31 is relatively strong, and a capacitive characteristic of the first transmission line feed portion 412 is relatively strong, so that a presented actual input impedance of the antenna is close to an ideal transmission impedance, a standing wave ratio is reduced, a bandwidth of the antenna 100 is broadened, and a technical problem in the prior art that a bandwidth of the antenna is relatively narrow because in the foregoing a coaxial line is directly connected to a radiating patch and an inner conductor that is approximately perpendicular to the radiating patch has a relatively strong inductive characteristic in a circuit is resolved.

Figure 10:
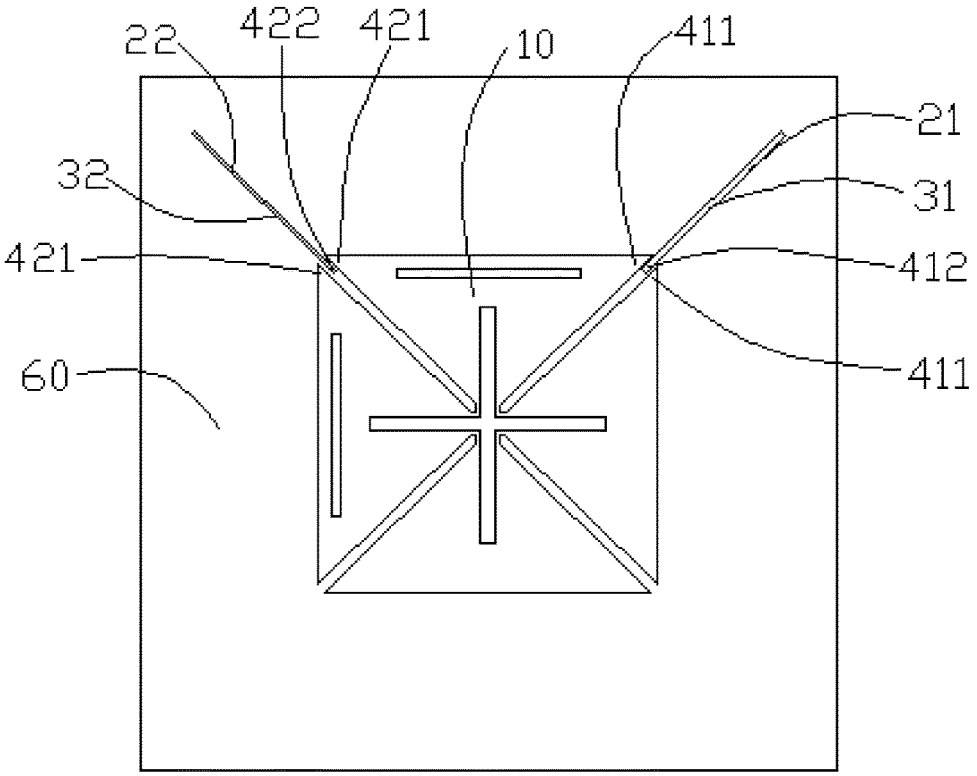
FIG. 10 is a top view of an antenna according to a sixth implementation manner of this application.

Further, as shown in FIG. 10, the antenna 100 is a dual-polarized antenna. The antenna 100 includes the first transmission line 21, the second transmission line 22, the first connection portion 31, the second connection portion 32, the first feed portion 41, and the second feed portion 42, and polarization directions of radiated electromagnetic waves excited by the first feed portion 41 and the second feed portion 42 are perpendicular to each other. Preferably, the two first radiation feed portions 411 of the first feed portion 41 are, and the first transmission line feed portion 412 itself is, symmetric with respect to a first straight line, and the two second radiation feed portions 421 of the second feed portion 42 are, and the second transmission line feed portion 422 itself is, symmetric with respect to the first straight line. The first straight line and the second straight line are perpendicular.

Figure 11:
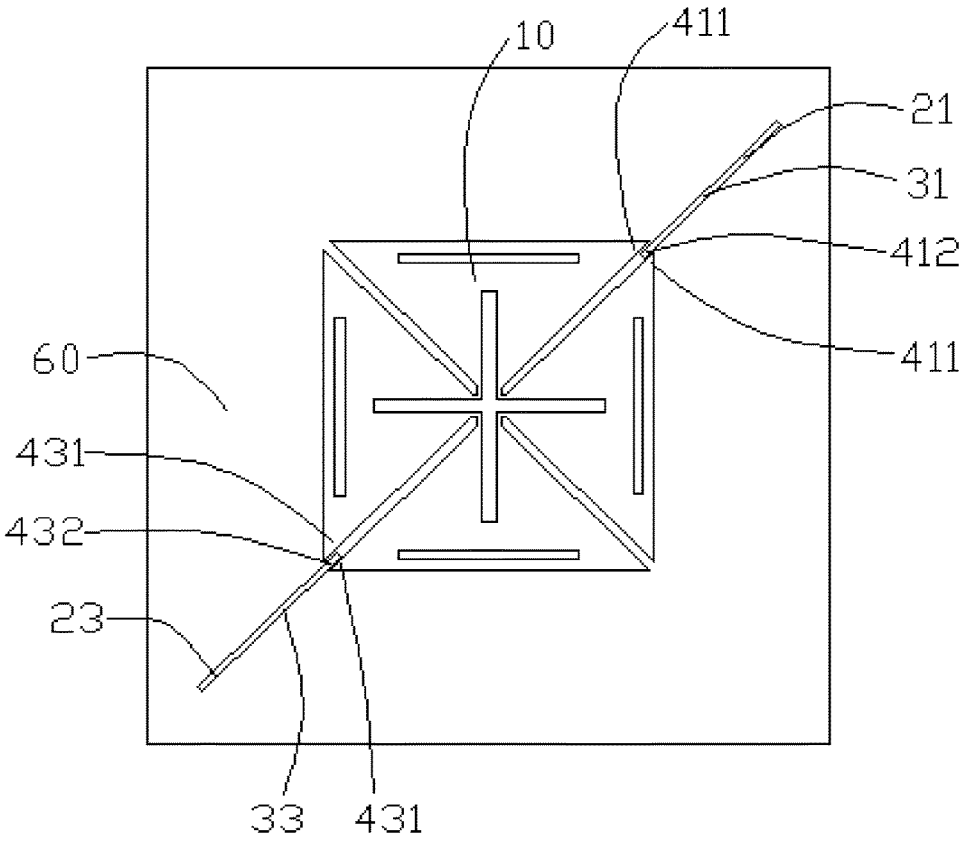
FIG. 11 is a top view of an antenna according to a seventh implementation manner of this application.

Further, as shown in FIG. 11, the antenna 100 is a single-polarized antenna. The antenna 100 includes the first transmission line 21, the second transmission line 22, the first connection portion 31, the second connection portion 32, the first feed portion 41, and the second feed portion 42, and polarization directions of radiated electromagnetic waves excited by the first feed portion 41 and the second feed portion 42 are perpendicular to each other. Preferably, the two first radiation feed portions 411 of the first feed portion 41 are, and the first transmission line feed portion 412 itself is, symmetric with respect to a first straight line, and the two second radiation feed portions 421 of the second feed portion 42 are, and the second transmission line feed portion 422 itself is, symmetric with respect to the first straight line. The first straight line and the second straight line are overlapped.

The first connection portion 31 and the second connection portion 32 that are disposed opposite the radiating patch reference ground 11, the two first radiation feed portions 411 and the two second radiation feed portions 421 that are located on one plane, and the first transmission line feed portion 412 and the second transmission line feed portion 422 are disposed. Based on a principle in which an inductive characteristic strength is directly proportional to a distance and a capacitive characteristic strength is inversely proportional to a distance, because a distance between each of the first connection 31 and the second connection portion 32 and the radiating patch reference ground 11 is greater than a distance between each of the first transmission line feed portion 412 and the second transmission line feed portion 422 and the two first radiation feed portions 411, inductive characteristics of the first connection portion 31 and the second connection portion 32 are relatively strong, and capacitive characteristics of the first transmission line feed portion 412 and the second transmission line feed portion 422 are relatively strong, so that a presented actual input impedance of the antenna is close to an ideal transmission impedance, a standing wave ratio is reduced, a bandwidth of the antenna 100 is broadened, and a technical problem in the prior art that a bandwidth of the antenna is relatively narrow because in the foregoing a coaxial line is directly connected to a radiating patch and an inner conductor that is approximately perpendicular to the radiating patch has a relatively strong inductive characteristic in a circuit is resolved.

In this application, the perpendicularity, overlap, 180 degrees, symmetry, and the like are not absolute perpendicularity, overlap, 180 degrees, and symmetry in a geometric sense. Non-absolute perpendicularity, overlap, 180 degrees, and symmetry caused by tolerances and errors produced in a process of manufacturing and assembly also fall within the scope of perpendicularity, overlap, 180 degrees, and symmetry.

As shown in FIG. 3, the antenna 100 further includes a bottom plate 70. The bottom plate 70 is configured to support the top plate 60. A surface, of the bottom plate 70, opposite the radiating patch 10 is partially concave to form a groove 71. The radiating patch reference ground 30 is disposed at a bottom of the groove 71. The bottom plate 70 may be made of a metal material. In this implementation manner, the radiating patch reference ground 30 is disposed at the bottom of the groove 71. In another implementation manner, as shown in FIG. 6, FIG. 7, and FIG. 8, the radiating patch reference ground 30 and the bottom plate 70 are integrally formed. In this implementation manner, the bottom plate 70 is configured to support the top plate 60. In another implementation manner, the top plate 60 may be supported in another manner.

Further, in the foregoing implementation manner, the first transmission line 21, the second transmission line 22, the third transmission line 23, the fourth transmission line 24, the first connection portion 31, the second connection portion 32, the third connection portion 33, the fourth connection portion 34, the first transmission line feed portion 412, the second transmission line feed portion 422, the third transmission line feed portion 432, and the fourth transmission line feed portion 442 are all disposed on the top plate 60. In another implementation manner, as shown in FIG. 12 and FIG. 13, the antenna 100 not only includes the top plate 60, but also includes a bottom plate 90 disposed opposite the top plate 60, where the bottom plate 90 includes an upper surface 91 opposite the top plate 60 and a lower surface 92 opposite to the upper surface 91.

The radiating patch 10, the two first radiation feed portions 411, the two second radiation feed portions 421, the two third radiation feed portions 431, the two fourth radiation feed portions 441, the first transmission line feed portion 412, the second transmission line feed portion 422, the third transmission line feed portion 432, and the fourth transmission line feed portion 442 are disposed on the top plate 60. In this implementation manner, the radiating patch 10, the two first radiation feed portions 411, the two second radiation feed portions 421, the two third radiation feed portions 431, the two fourth radiation feed portions 441, the first transmission line feed portion 412, the second transmission line feed portion 422, the third transmission line feed portion 432, and the fourth transmission line feed portion 442 are disposed on the upper surface 91 of the top plate 60. In another implementation manner, the radiating patch 10, the two first radiation feed portions 411, the two second radiation feed portions 421, the two third radiation feed portions 431, the two fourth radiation feed portions 441, the first transmission line feed portion 412, the second transmission line feed portion 422, the third transmission line feed portion 432, and the fourth transmission line feed portion 442 are disposed on the lower surface 92 of the top plate 60, or the radiating patch 10, the two first radiation feed portions 411, the two second radiation feed portions 421, the two third radiation feed portions 431, the two fourth radiation feed portions 441, the first transmission line feed portion 412, the second transmission line feed portion 422, the third transmission line feed portion 432, and the fourth transmission line feed portion 442 may also be disposed on different surfaces (the upper surface 91 or the lower surface 92) of the top plate 60.

The radiating patch reference ground 30 is disposed on the bottom plate 90, and corresponds to a position of the radiating patch 10. In this implementation manner, the radiating patch reference ground 30 is disposed on a surface, of the bottom plate 90, opposite the top plate 60. In another implementation manner, the radiating patch reference ground 30 may also be disposed on a surface, of the bottom plate 90, opposite to the top plate 60. The first transmission line 21, the second transmission line 22, the third transmission line 23, and the fourth transmission line 24 are disposed on one surface of the upper surface 91 and the lower surface 92, and the transmission line reference ground 40 is disposed on the other surface of the upper surface 91 and the lower surface 92. Projections of the first transmission line 21, the second transmission line 22, the third transmission line 23, and the fourth transmission line 24 on a surface on which the transmission line reference ground 40 is located are located on a projection of the transmission line reference ground 40 on the surface. The first connection portion 31, the second connection portion 32, the third connection portion 33, and the fourth connection portion 34 are disposed between the top plate 60 and the bottom plate 90, and are respectively configured to electrically connect the first transmission line feed portion 412 and the first transmission line 21, the second transmission line feed portion 422 and the second transmission line 22, the third transmission line feed portion 432 and the third transmission line 23, and the fourth transmission line feed portion 442 and the fourth transmission line 24. In this implementation manner, the first connection portion 31, the second connection portion 32, the third connection portion 33, and the fourth connection portion 34 are probes. In another implementation manner, the first connection portion 31, the second connection portion 32, the third connection portion 33, and the fourth connection portion 34 may be other conductors.

Figure 12:
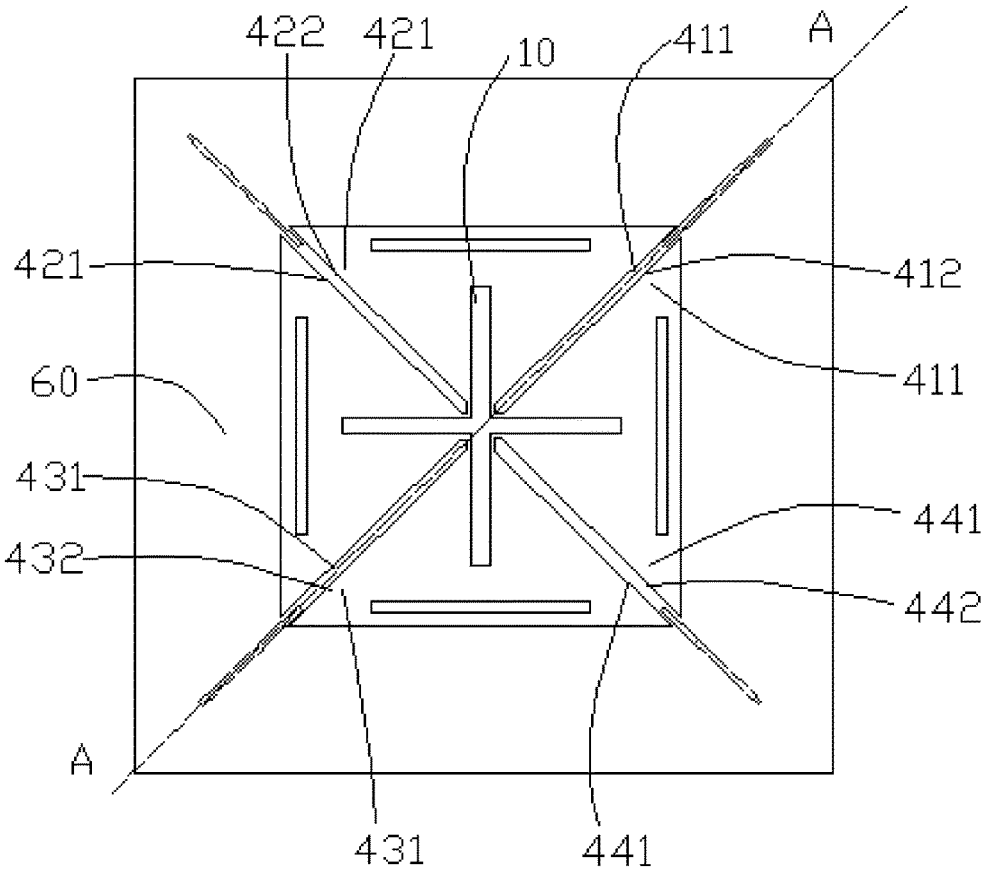
FIG. 12 is a top view of an antenna according to an eighth implementation manner of this application.
Figure 13:
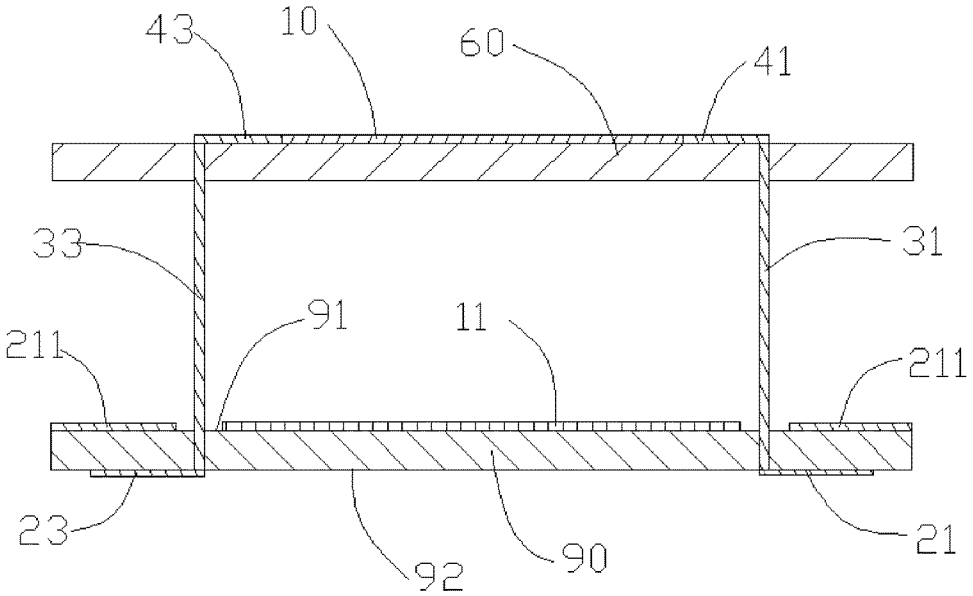
FIG. 13 is a schematic sectional view of the antenna in FIG. 12.

When the antenna 100 shown in FIG. 12 and FIG. 13 transmits a signal, signals on the first transmission line 21, the second transmission line 22, the third transmission line 23, and the fourth transmission line 24 are respectively transferred to the first transmission line feed portion 412, the second transmission line feed portion 422, the third transmission line feed portion 432, and the fourth transmission line feed portion 442 using the first connection portion 31, the second connection portion 32, the third connection portion 33, and the fourth connection portion 34, are respectively coupled to the two first radiation feed portions 411, the two second radiation feed portions 421, the two third radiation feed portions 431, and the two fourth radiation feed portions 441 using the first transmission line feed portion 412, the second transmission line feed portion 422, the third transmission line feed portion 432, and the fourth transmission line feed portion 442, and are radiated using the radiating patch 10. When receiving the signal, the radiating patch 10 separately couples the received signal to the first transmission line feed portion 412, the second transmission line feed portion 422, the third transmission line feed portion 432, and the fourth transmission line feed portion 442 using the two first radiation feed portions 411, the two second radiation feed portions 421, the two third radiation feed portions 431, and the two fourth radiation feed portions 441, and then transfers the signal to the first transmission line 21, the second transmission line 22, the third transmission line 23, and the fourth transmission line 24 respectively using the first connection portion 31, the second connection portion 32, the third connection portion 33, and the fourth connection portion 34.

Embodiment 2

Figure 14:
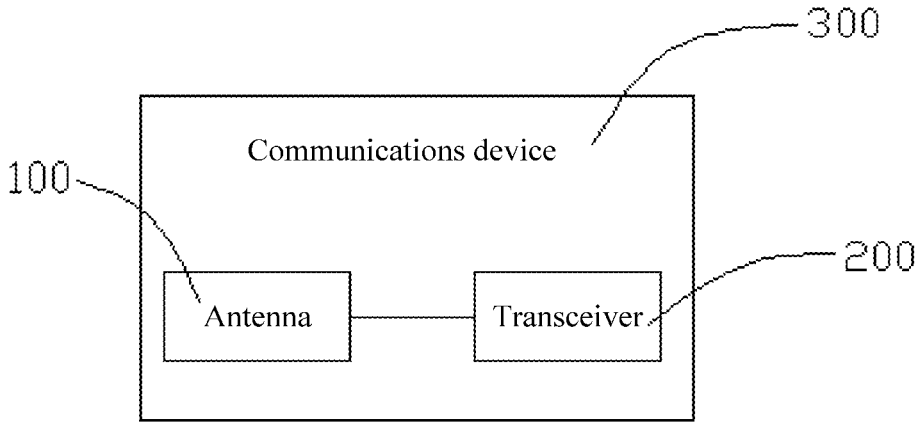
FIG. 14 is a schematic structural diagram of communication according to this application.
Figure 15:
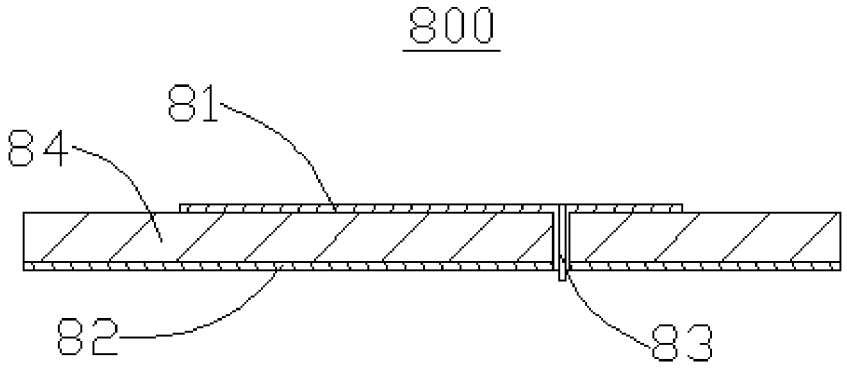
FIG. 15 is a schematic sectional view of an antenna in the prior art.

Based on a same disclosure concept, this application further provides a communications device. As shown in FIG. 14, the communications device 300 includes the antenna 100 in Embodiment 1 and a transceiver 200 configured to receive a signal from the antenna 100 or send a signal to the antenna 100.

In the foregoing communications device, the first connection portion 31 disposed opposite the radiating patch reference ground 11, the two first radiation feed portions 411 located on one plane, and the first transmission line feed portion 412 are disposed. Based on a principle in which an inductive characteristic strength is directly proportional to a distance and a capacitive characteristic strength is inversely proportional to a distance, because a distance between the first connection portion 31 and the radiating patch reference ground 11 is greater than a distance between the first transmission line feed portion 412 and the two first radiation feed portions 411, an inductive characteristic of the first connection portion 31 is relatively strong, and a capacitive characteristic of the first transmission line feed portion 412 is relatively strong, so that a presented actual input impedance of the antenna is close to an ideal transmission impedance, a standing wave ratio is reduced, a bandwidth of the antenna 100 is broadened, and a technical problem in the prior art that a bandwidth of the antenna is relatively narrow because in the foregoing a coaxial line is directly connected to a radiating patch and an inner conductor that is approximately perpendicular to the radiating patch has a relatively strong inductive characteristic in a circuit is resolved.

Although some preferred embodiments of the present disclosure have been described, persons skilled in the art can make changes and modifications to these embodiments once they learn the basic inventive concept. Therefore, the following claims are intended to be construed as to cover the exemplary embodiments and all changes and modifications falling within the scope of the present disclosure.

Obviously, persons skilled in the art can make various modifications and variations to the present disclosure without departing from the spirit and scope of the present disclosure. The present disclosure is intended to cover these modifications and variations provided that they fall within the scope of protection defined by the following claims and their equivalent technologies.

What is claimed is:

1. An antenna, comprising:

a radiating patch configured to transmit and receive a radio frequency signal;

a radiating patch reference ground disposed opposite the radiating patch;

a first transmission line configured to transmit the radio frequency signal;

a transmission line reference ground disposed opposite the first transmission line;

a first connection portion connected to the first transmission line and disposed opposite the radiating patch reference ground; and a first feed portion comprising a first transmission line feed portion and two first radiation feed portions, wherein the two first radiation feed portions are connected to the radiating patch and are configured to receive a radio frequency signal of the radiating patch or transfer a radio frequency signal to the radiating patch, wherein the first transmission line feed portion is connected to the first transmission line using the first connection portion, so that the first transmission line feed portion and the first transmission line can transmit the radio frequency signal to each other, wherein mutually coupled feeding is performed between the two first radiation feed portions and the first transmission line feed portion, wherein the two first radiation feed portions are disposed on a plane, the first transmission line feed portion is disposed between the two first radiation feed portions, or a projection of the first transmission line feed portion on the plane is located between projections of the two first radiation feed portions on the plane, and wherein a distance between the first connection portion and the radiating patch reference ground is greater than a distance between the first transmission line feed portion and the first radiation feed portions.

2. The antenna according to claim 1, further comprising:

a second transmission line disposed opposite the transmission line reference ground and configured to transmit the radio frequency signal;

a second connection portion disposed opposite the radiating patch reference ground and connected to the second transmission line;

a second feed portion comprising a second transmission line feed portion and two second radiation feed portions, wherein the two second radiation feed portions are connected to the radiating patch and are configured to receive a radio frequency signal of the radiating patch or transfer a radio frequency signal to the radiating patch, wherein the second transmission line feed portion is connected to the second transmission line using the second connection portion, so that the second transmission line feed portion and the second transmission line can transmit the radio frequency signal to each other; and wherein mutually coupled feeding is performed between the two second radiation feed portions and the second transmission line feed portion, wherein the two second radiation feed portions are disposed on the plane, the second transmission line feed portion is disposed between the two second radiation feed portions, or a projection of the second transmission line feed portion on the plane is located between projections of the two second radiation feed portions on the plane, wherein a distance between the second connection portion and the radiating patch reference ground is greater than a distance between the second transmission line feed portion and the second radiation feed portions, and wherein polarization directions of radiated electromagnetic waves excited by the second feed portion and the first feed portion are perpendicular to each other, or a phase difference of the radiated electromagnetic waves is 180 degrees.

3. The antenna according to claim 2, wherein the two first radiation feed portions are symmetric with respect to a first straight line, wherein the first transmission line feed portion itself is symmetric with respect to the first straight line, wherein the two second radiation feed portions are symmetric with respect to a second straight line, wherein the second transmission line feed portion itself is symmetric with respect to the second straight line, and wherein the first straight line and the second straight line are perpendicular or overlapped.

4. The antenna according to claim 2, further comprising a top plate, wherein the top plate comprises a lower surface and an upper surface opposite to the lower surface, wherein the radiating patch is disposed on the upper surface or the lower surface, wherein the first transmission line, the second transmission line, the first connection portion, and the second connection portion are disposed on one surface of the upper surface and the lower surface, wherein the transmission line reference ground is disposed on the other surface of the upper surface and the lower surface, and wherein the two first radiation feed portions, the first transmission line feed portion, the two second radiation feed portions, and the second transmission line feed portion are disposed on the upper surface or the lower surface.

5. The antenna according to claim 2, further comprising a top plate and a bottom plate disposed opposite the top plate, wherein the bottom plate comprises an upper surface opposite the top plate and a lower surface opposite to the upper surface, wherein the radiating patch, the two first radiation feed portions, the two second radiation feed portions, the first transmission line feed portion, wherein the second transmission line feed portion are disposed on the top plate, wherein the radiating patch reference ground is disposed on the bottom plate, and a projection of the radiating patch on the radiating patch reference ground is on the radiating patch reference ground, wherein the first transmission line and the second transmission line are disposed on one surface of the upper surface and the lower surface, wherein the transmission line reference ground is disposed on the other surface of the upper surface and the lower surface, wherein projections of the first transmission line and the second transmission line on the transmission line reference ground on the surface are located on a projection of the transmission line reference ground on the surface, and wherein the first connection portion and the second connection portion are located between the top plate and the bottom plate.

6. The antenna according to claim 2, further comprising:

a third transmission line and a fourth transmission line disposed opposite the transmission line reference ground and configured to transmit the radio frequency signal;

a third connection portion and a fourth connection portion disposed opposite the radiating patch reference ground, wherein the third connection portion is connected to the third transmission line, and wherein the fourth connection portion is connected to the fourth transmission line;

a third feed portion comprising a third transmission line feed portion and two third radiation feed portions, wherein the two third radiation feed portions are connected to the radiating patch and are configured to receive a radio frequency signal of the radiating patch or transfer a radio frequency signal to the radiating patch, wherein the third transmission line feed portion is connected to the third transmission line using the third connection portion, so that the third transmission line feed portion and the third transmission line can transmit the radio frequency signal to each other, wherein mutually coupled feeding is performed between the two third radiation feed portions and the third transmission line feed portion, wherein the two third radiation feed portions are disposed on the plane, the third transmission line feed portion is disposed between the two third radiation feed portions, or a projection of the third transmission line feed portion on the plane is located between projections of the two third radiation feed portions on the plane, and wherein a distance between the third connection portion and the radiating patch reference ground is greater than a distance between the third transmission line feed portion and the third radiation feed portions; and a fourth feed portion, comprising a fourth transmission line feed portion and two fourth radiation feed portions, wherein the two fourth radiation feed portions are connected to the radiating patch and are configured to receive a radio frequency signal of the radiating patch or transfer a radio frequency signal to the radiating patch, wherein the fourth transmission line feed portion is connected to the fourth transmission line using the fourth connection portion, so that the fourth transmission line feed portion and the fourth transmission line can transmit the radio frequency signal to each other, wherein mutually coupled feeding is performed between the two fourth radiation feed portions and the fourth transmission line feed portion, wherein the two fourth radiation feed portions are disposed on the plane, the fourth transmission line feed portion is disposed between the two fourth radiation feed portions, or a projection of the fourth transmission line feed portion on the plane is located between projections of the two fourth radiation feed portions on the plane, and wherein a distance between the fourth connection portion and the radiating patch reference ground is greater than a distance between the fourth transmission line feed portion and the fourth radiation feed portions, wherein the radiating patch is located in an area enclosed by the first connection portion, and wherein the second connection portion, the third connection portion, and the fourth connection portion, and polarization directions of radiated electromagnetic waves excited by any two feed portions of the first feed portion, the second feed portion, the third feed portion, and the fourth feed portion are perpendicular to each other, or a phase difference of the radiated electromagnetic waves is 180 degrees.

7. The antenna according to claim 6, wherein the two first radiation feed portions are symmetric with respect to a first straight line, and the first transmission line feed portion itself is symmetric with respect to the first straight line, wherein the two second radiation feed portions are symmetric with respect to a second straight line, the second transmission line feed portion itself is symmetric with respect to the second straight line, and the first straight line and the second straight line are perpendicular, wherein the two third radiation feed portions are symmetric with respect to the first straight line, and the third transmission line feed portion itself is symmetric with respect to the first straight line, and wherein the two fourth radiation feed portions are symmetric with respect to the second straight line, the fourth transmission line feed portion itself is symmetric with respect to the second straight line, and the first straight line and the second straight line are perpendicular or overlapped.

8. The antenna according to claim 6, further comprising a top plate, wherein the top plate comprises a lower surface and an upper surface opposite to the lower surface, wherein the radiating patch is disposed on the upper surface or the lower surface, wherein the first transmission line, the second transmission line, the third transmission line, the first connection portion, the second connection portion, and the third connection portion are disposed on one surface of the upper surface and the lower surface, and the transmission line reference ground is disposed on the other surface of the upper surface and the lower surface, and wherein the two first radiation feed portions, the first transmission line feed portion, the two second radiation feed portions, the second transmission line feed portion, the two third radiation feed portions, and the third transmission line feed portion are disposed on the upper surface or the lower surface.

9. The antenna according to claim 6, further comprising a top plate and a bottom plate disposed opposite the top plate, wherein the bottom plate comprises an upper surface opposite the top plate and a lower surface opposite to the upper surface, wherein the radiating patch, the two first radiation feed portions, the two second radiation feed portions, the two third radiation feed portions, the first transmission line feed portion, the second transmission line feed portion, and the third transmission line feed portion are disposed on the top plate, wherein the radiating patch reference ground is disposed on the bottom plate, and a projection of the radiating patch on the radiating patch reference ground is on the radiating patch reference ground, wherein the first transmission line, the second transmission line, and the third transmission line are disposed on one surface of the upper surface and the lower surface, the transmission line reference ground is disposed on the other surface of the upper surface and the lower surface, and projections of the first transmission line, the second transmission line, and the third transmission line on the transmission line reference ground on the surface are located on a projection of the transmission line reference ground on the surface, and wherein the first connection portion, the second connection portion, and the third connection portion are located between the top plate and the bottom plate.

10. The antenna according to claim 1, wherein the two first radiation feed portions are symmetric with respect to a straight line, and wherein the first transmission line feed portion itself is symmetric with respect to the straight line.

11. The antenna according to claim 1, further comprising a top plate, wherein the top plate comprises a lower surface and an upper surface opposite to the lower surface, wherein the radiating patch is disposed on the upper surface or the lower surface, wherein the first transmission line and the first connection portion are disposed on one surface of the upper surface and the lower surface, and the transmission line reference ground is disposed on the other surface of the upper surface and the lower surface, and wherein the two first radiation feed portions and the first transmission line feed portion are disposed on the upper surface or the lower surface.

12. The antenna according to claim 4, further comprising two radiating patches, separately disposed on the upper surface and the lower surface.

13. The antenna according to claim 8, further comprising two radiating patches, separately disposed on the upper surface and the lower surface.

14. The antenna according to claim 11, further comprising two radiating patches, separately disposed on the upper surface and the lower surface.

15. The antenna according to claim 4, further comprising a bottom plate disposed opposite the radiating patch, a surface, of the bottom plate, opposite the radiating patch is partially concave to form a groove, wherein the radiating patch reference ground is disposed at a bottom of the groove.

16. The antenna according to claim 8, further comprising a bottom plate disposed opposite the radiating patch, a surface, of the bottom plate, opposite the radiating patch is partially concave to form a groove, wherein the radiating patch reference ground is disposed at a bottom of the groove.

17. The antenna according to claim 11, further comprising a bottom plate disposed opposite the radiating patch, a surface, of the bottom plate, opposite the radiating patch is partially concave to form a groove, wherein the radiating patch reference ground is disposed at a bottom of the groove.

18. The antenna according to claim 12, further comprising a bottom plate disposed opposite the radiating patch, a surface, of the bottom plate, opposite the radiating patch is partially concave to form a groove, and the radiating patch reference ground is disposed at a bottom of the groove.

19. The antenna according to claim 1, further comprising a top plate and a bottom plate disposed opposite the top plate, wherein the bottom plate comprises an upper surface opposite the top plate and a lower surface opposite to the upper surface, wherein the radiating patch, the two first radiation feed portions, and the first transmission line feed portion are disposed on the top plate, wherein the radiating patch reference ground is disposed on the bottom plate, and a projection of the radiating patch on the radiating patch reference ground is on the radiating patch reference ground, wherein the first transmission line is disposed on one surface of the upper surface and the lower surface, the transmission line reference ground is disposed on the other surface of the upper surface and the lower surface, and a projection of the first transmission line on the transmission line reference ground on the surface is located on a projection of the transmission line reference ground on the surface, and wherein the first connection portion is located between the top plate and the bottom plate.

20. A communications device, comprising:

an antenna, comprising:

a radiating patch configured to transmit and receive a radio frequency signal;

a radiating patch reference ground disposed opposite the radiating patch;

a first transmission line configured to transmit the radio frequency signal;

a transmission line reference ground disposed opposite the first transmission line;

a first connection portion connected to the first transmission line and disposed opposite the radiating patch reference ground; and a first feed portion comprising a first transmission line feed portion and two first radiation feed portions, wherein the two first radiation feed portions are connected to the radiating patch and are configured to receive a radio frequency signal of the radiating patch or transfer a radio frequency signal to the radiating patch; and a transceiver configured to receive a signal from the antenna or send a signal to the antenna.

wherein the first transmission line feed portion is connected to the first transmission line using the first connection portion, so that the first transmission line feed portion and the first transmission line can transmit the radio frequency signal to each other, wherein mutually coupled feeding is performed between the two first radiation feed portions and the first transmission line feed portion, wherein the two first radiation feed portions are disposed on a plane, the first transmission line feed portion is disposed between the two first radiation feed portions, or a projection of the first transmission line feed portion on the plane is located between projections of the two first radiation feed portions on the plane, and wherein a distance between the first connection portion and the radiating patch reference ground is greater than a distance between the first transmission line feed portion and the first radiation feed portions.

* * * * *